United States Patent [19]

Barisoni

[11] Patent Number: 5,045,129

[45] Date of Patent: Sep. 3, 1991

[54] PROCESS FOR THE PRODUCTION OF SEMIPROCESSED NON ORIENTED GRAIN ELECTRICAL STEEL

[75] Inventor: Mario Barisoni, Ariccia, Italy

[73] Assignee: Centro Sviluppo Materiali S.p.A., Rome, Italy

[21] Appl. No.: 629,246

[22] Filed: Dec. 18, 1990

[30] Foreign Application Priority Data

Dec. 21, 1989 [IT] Italy ..... 47578 A/89

[51] Int. Cl.[5] ..... H01F 1/04

[52] U.S. Cl. ..... 148/111; 148/120; 148/307; 148/110; 148/112

[58] Field of Search ..... 148/111, 112, 307, 308

[56] References Cited

U.S. PATENT DOCUMENTS 4,666,534 5/1987 Miyoshi et al. ..... 148/120

FOREIGN PATENT DOCUMENTS 0309923 12/1989 Japan .

*Primary Examiner*—R. Dean

*Assistant Examiner*—Sikyin Ip

*Attorney, Agent, or Firm*—Allegretti & Witcoff, Ltd.

[57] ABSTRACT

The present invention concerns a process for the production of semiprocessed non oriented grain electrical steel. More precisely it provides a solution to the technical problem of obtaining non oriented grain sheet or strip characterized by high magnetic permeability and low magnetic losses. According to the invention, starting from a steel with a low S, N and C content, through appropriate selection of hot-rolling variables and high-temperature annealing prior to cold rolling, a big improvement is achieved in the magnetic characteristics of the product, thanks to a better compromise between grain size and crystal orientation.

3 Claims, No Drawings

PROCESS FOR THE PRODUCTION OF SEMIPROCESSED NON ORIENTED GRAIN ELECTRICAL STEEL

BACKGROUND OF THE INVENTION

The present invention concerns a process for the production of semiprocessed non oriented grain electrical sheet with high magnetic permeability and low magnetic losses. More precisely it concerns a steel with a low S, N and C content characterized by careful control of chemical composition and treatment via an appropriate thermomechanical cycle during manufacture. Non oriented grain sheet is, of course, marketed in "semiprocessed" and "processed form, the former requiring successive heat treatment by the user.

In both cases the sheet is used in the cores of electrical machines, in low-power transformers, in relays and in starters for lights.

If constructors so require, namely when it is necessary to produce high-output motors, such as for instance in the case of sealed units for refrigerators, the following solutions are commonly selected: increase in size of core to reduce magnetic induction, reduction in sheet thickness, and increase in Si content. In all cases manufacturing costs are markedly higher.

The alternative solution is to produce sheet that unites the characteristic of low magnetic losses with that of high magnetic permeability, thus ensuring more contained dissipation of energy both in the core and the windings.

To obtain this type of sheet, action must be taken on the variables that control magnetic permeability and total magnetic losses, and particularly losses due to static hysteresis which, of course, depend mainly on the inclusions content and grain size. The inclusions commonly present are oxides, sulphides and nitrides. The oxygen content is normally limited by the addition of dexoidants or by vacuum carbodeoxidation. The sulphur is reduced by the addition of desulphurizing elements, while the adverse influence of nitrogen, which is inevitably present, is limited by high-temperature precipitation as AlN; the amount of Al used does not generally exceed 0.5%.

Regarding grain growth capable of improving magnetic permeability and magnetic losses, it should be recalled that this can be attained either by high-temperature annealing (800 ° C. or more) of the cold-rolled sheet, or by the joint action of critical cold rolling of the recrystallized sheet with reduction of area of about 6–8%, and subsequent decarburizing annealing performed as per Euronorm 165/81.

In both cases the growth of crystalline grain is accompanied by evolution of the corresponding texture towards magnetically less favourable components, thus limiting the benefits obtained. The normal production process for non oriented grain sheet includes heating the slab to about 1250 ° C., hot rolling to strip about 2 mm thick, sand-blasting, pickling, cold rolling, recrystallization annealing, cold rolling with reduction of area of about 5–8% and subsequent decarburizing annealing conducted by the user of the cut product.

Surprisingly, it has now been found that with the combination of careful refining of the liquid steel, appropriate chemical composition, a slab-to-sheet working process as per the invention, and annealing of the ensuing hot strip at a suitable temperature which depends on the Si content, it is possible to obtain non oriented grain electrical sheet or strip with higher magnetic permeability and lower magnetic losses than can be obtained with known methods on sheet of the same thickness and Si content.

DESCRIPTION OF THE PRESENT INVENTION

More precisely, the present invention consists in a process for the production of semiprocessed non oriented grain electrical sheet with high magnetic permeability and low magnetic losses, characterized by the combination of a steel, previously vacuum carbodeoxized having the following chemical composition:

| | | |
|---|---|---|
| C = 0.0020–0.0100% | Si = 0.2–2.0% | S = 0.001–0.101% |
| N = 0.0010–0.0060% | Al = 0.2–0.5% | Mn = 0.200–0.800% |

which is subjected to the following manufacturing cycle:

treatment of the heat including heating of slabs to a temperature between 1100 ° C. and 1200 ° C., finishing of hot rolling at a temperature between 830 ° C. and 950 ° C. and coiling of the strip at a temperature between 650 ° C. and 800 ° C.;

annealing of the hot strip at temperatures in the 880°–1030 ° C. range for times between 30 and 120 seconds;

cold rolling with a reduction of area between 70 and 85%, without intermediate annealing;

recrystallization annealing at temperature between 620 ° C. and 700 ° C. for 30 to 120 seconds.

Only by closely adhering to the thermomechanical cycle described, together with careful choice of chemical composition it is possible to achieve optimum grain size and crystal orientation to obtain low magnetic losses and high magnetic permeability at the same time, while rendering the sheet or strip suitable for shearing.

To highlight the beneficial effects obtained through the present invention, an example is provided purely by way of explanation, without in any way limiting the scope of the invention or claims thereto. In the example the invention (whose characteristics are indicated by the letter A in the Table) is compared with a steel (whose characteristics are indicated by the letter R in the Table) from the same heat but processed according to the classical transformation cycle for semiprocessed sheet.

| | Thickness mm | $B_{5000}$ T | $(\mu_p)_{1.5}$ G/Oe | $P_{1.0}$ W/kg | $P_{1.5}$ W/Kg | d μm |
|---|---|---|---|---|---|---|
| A | 0.49 | 1.746 | 3245 | 1.68 | 3.75 | 49 |
| R | 0.49 | 1.691 | 1425 | 1.61 | 4.10 | 80 |

The measurements were made at 50 Hz.

$B_{5000}$ indicates the induction measured with a field of 5000 A/m, $(u_p)_{1.5}$ indicates the peak permeability at 1.5 T, while $P_{1.0}$ and $P_{1.5}$ are the magnetic losses at 1.0 and 1.5 T (tesla) and d the average size of the grain in the finished sheet. The Table was composed by taking Epstein samples of about 0.5 kg from the head, centre and tail of the strips, 50% being cut in the rolling direction and the other 50% perpendicular to that direction.

The present invention (A) in this example was obtained from a slab having of the following composition:

| | | |
|---|---|---|
| Si = 1.0600% | Al = 0.300% | Mn = 0.5000% |
| C = 0.0060% | S = 0.004% | N = 0.0053% |

This was processed by heating to 1180 ° C. where it was held for four hours and then hot-rolling to a final thickness of 2.0 mm, the finish-rolling temperature being 890 ° C. followed by coiling at 720 ° C.

The strip thus obtained was heated to 920 ° C. and held for 60 seconds, sand-blasted, pickled and cold-rolled to a thickness of 0.49 mm, then recrystallized at 630 ° C. for 60 seconds.

The semiprocessed sheet processed in the classical manner (R) was subjected to the following cycle. Slab heated to 1250 ° C., hot-rolled to a thickness of 2.0 mm, the finish-rolling temperature being 960 ° C., followed by coiling at 630 ° C. The strip obtained in this manner was sand-blasted, pickled and cold-rolled to a thickness of 0.49 mm, then recrystallized at 700 ° C. for 120 seconds, followed by cold rolling with a reduction of area of 8%.

Samples A and R were both decarburized at 790 ° C. for 2 hours, as per Euronorm 165/81.

While a presently preferred embodiment has been described, it is understood that the present disclosure is made only by way of example and that the concepts of this invention may be adaptable to other embodiments, and those skilled in the art may vary the structure thereof without departing from the essential spirit of the invention.

I claim:

1. Process for the production of semiprocessed non oriented grain sheet with high magnetic permeability and low magnetic losses, characterized by the combination of a previously vacuum carbodeoxidized steel containing:

| | | |
|---|---|---|
| C = 0.0020-0.0100% | Si = 0.2-2.0% | S = 0.001-0.10% |
| N = 0.0010-0.0060% | Al = 0.2-0.5% | Mn = 0.200-0.800% |

which is subjected to the following manufacturing cycle:

treatment of the heat including heating of the slabs to a temperature between 1100 ° C. and 1200 ° C., finish of hot rolling at a temperature between 830 ° C. and 950 ° C. and coiling at a temperature between 650 ° C. and 800 ° C.;

annealing of the hot-rolled strip at temperatures in the 880 ° C. to 1030 ° C. range for between 30 and 120 seconds;

cold rolling with a reduction of area between 70% and 85%, without intermediate annealing;

recrystallization annealing at temperatures between 620 ° C. and 700 ° C. for between 30 and 120 seconds.

2. A process as in claim 1 wherein the steel has the following composition:

Si=1.060%; C=0.006%; Al=0.300%; S=0.004%; Mn=0.500% and N=0.0053%.

3. A process for the production of semi processed non-oriented grain sheet of a vacuum carbodeoxidized steel with high magnetic permeability and low magnetic losses, characterized by the steps of providing slabs of carbodeoxidized steel, heating the slabs to a temperature between 1100° C. and 1200° C., finish rolling the slabs to a strip at a temperature between 830°60 C. and 950° C., coining the strip at a temperature between 650° C. and 800° C., annealing the strip at a temperature in the range of 880° C. to 1030° C. for between 30 and 120 seconds, cold rolling the strip with a reduction of area between 70% and 85% without intermediate annealing and recrystallization annealing at a temperature in the range of 620°60 C. to 700° C. for between 30 and 120 seconds.

* * * * *